US009301613B1

(12) United States Patent
Mattis

(10) Patent No.: US 9,301,613 B1
(45) Date of Patent: Apr. 5, 2016

(54) MOBILE SEAT SYSTEM

(71) Applicant: Melloyde Mattis, Lauderhill, FL (US)

(72) Inventor: Melloyde Mattis, Lauderhill, FL (US)

( * ) Notice: Subject to any disclaimer, the term of this patent is extended or adjusted under 35 U.S.C. 154(b) by 6 days.

(21) Appl. No.: 14/260,884

(22) Filed: Apr. 24, 2014

(51) Int. Cl.

| | |
|---|---|
| ***A47C 3/00*** | (2006.01) |
| ***A47C 3/16*** | (2006.01) |
| ***A47C 1/00*** | (2006.01) |
| ***A47C 7/02*** | (2006.01) |

(52) U.S. Cl.
CPC ... *A47C 3/16* (2013.01); *A47C 1/00* (2013.01); *A47C 7/02* (2013.01)

(58) Field of Classification Search
CPC ..... A47C 7/004; A47C 9/08; A47C 1/08; A47C 3/18; A47C 3/026; A47C 13/00; B62B 3/02; B62B 9/28
USPC ..... 280/32.5, 32.6, 79.2; 297/440.14, 297/451.8, 195.1; 312/263
See application file for complete search history.

(56) References Cited

U.S. PATENT DOCUMENTS

| | | | | |
|---|---|---|---|---|
| 2,267,158 | A | 12/1941 | Locke | |
| 3,976,155 | A | 8/1976 | Esch | |
| D266,292 | S | 9/1982 | Leffler et al. | |
| 4,397,374 | A | 8/1983 | Rumage et al. | |
| D298,674 | S | 11/1988 | Koller, Sr. | |
| 5,611,551 | A | 3/1997 | Lin | |
| 6,398,234 | B1 | 6/2002 | Brown | |
| 6,488,346 | B2 * | 12/2002 | Chen | 312/263 |
| 6,672,660 | B2 * | 1/2004 | Hoshino | 297/195.1 |
| 6,733,073 | B2 | 5/2004 | Whiteside et al. | |
| D579,679 | S | 11/2008 | Qian et al. | |
| 7,658,442 | B1 | 2/2010 | Whiteside et al. | |

* cited by examiner

*Primary Examiner* — Bryan Evans

(57) ABSTRACT

A mobile seat system for positioning a user low to a ground surface and enabling the user to move about as needed. The system features a base with a plurality of caster wheels and a cushion that is removably attached to the base via a screw-like mechanism. The cushion may have a back support component to help support the user's back.

1 Claim, 4 Drawing Sheets

(ISO View)

(ISO View)

(Bottom View)

(Front View)

(Top View)

(Side View with alternate seat)

MOBILE SEAT SYSTEM

FIELD OF THE INVENTION

The present invention relates to chairs and seats, more particularly to mobile seats that allow users to perform work at levels near the ground.

BACKGROUND OF THE INVENTION

Many individuals experience knee pain or back pain when they perform tasks that require working near ground surfaces. The present invention features a mobile seat system that positions the user near the ground surface. The mobile seat system allows the user to remain seated and move about easily.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a mobile seat system (100) for positioning a user low to a ground surface. In some embodiments, the system (100) comprises (a) a base (110), a plurality of caster wheels (120) are disposed on a bottom surface (116) of the base (110), a threaded protrusion (130) extends upwardly from a top surface (115) of the base (110); (b) a base cushion (210), wherein a threaded indentation (230) is disposed in the bottom surface (216) of the base cushion (210), the threaded indentation (230) is adapted to accept the threaded protrusion (130) of the base (110) to temporarily attach the base cushion (210) to the base (110); and (c) a support cushion (310), a back support component (320) extends upwardly from the support cushion (310) to support a user's back, wherein a threaded indentation (330) is disposed in a bottom surface of the support cushion (310), the threaded indentation (330) is adapted to accept the threaded protrusion (130) of the base (110) to temporarily attach the support cushion (310) to the base (110). In some embodiments, the base cushion (210) and support cushion (310) are interchangeable on the base (110). In some embodiments, the system (100) positions the user close to the ground surface. In some embodiments, the wheels (120) are arranged around the outer edge of the bottom surface (116) of the base (110). In some embodiments, the base cushion (210) covers the entire top surface (116) of the base (110).

DESCRIPTION OF PREFERRED EMBODIMENTS

Figure 1:
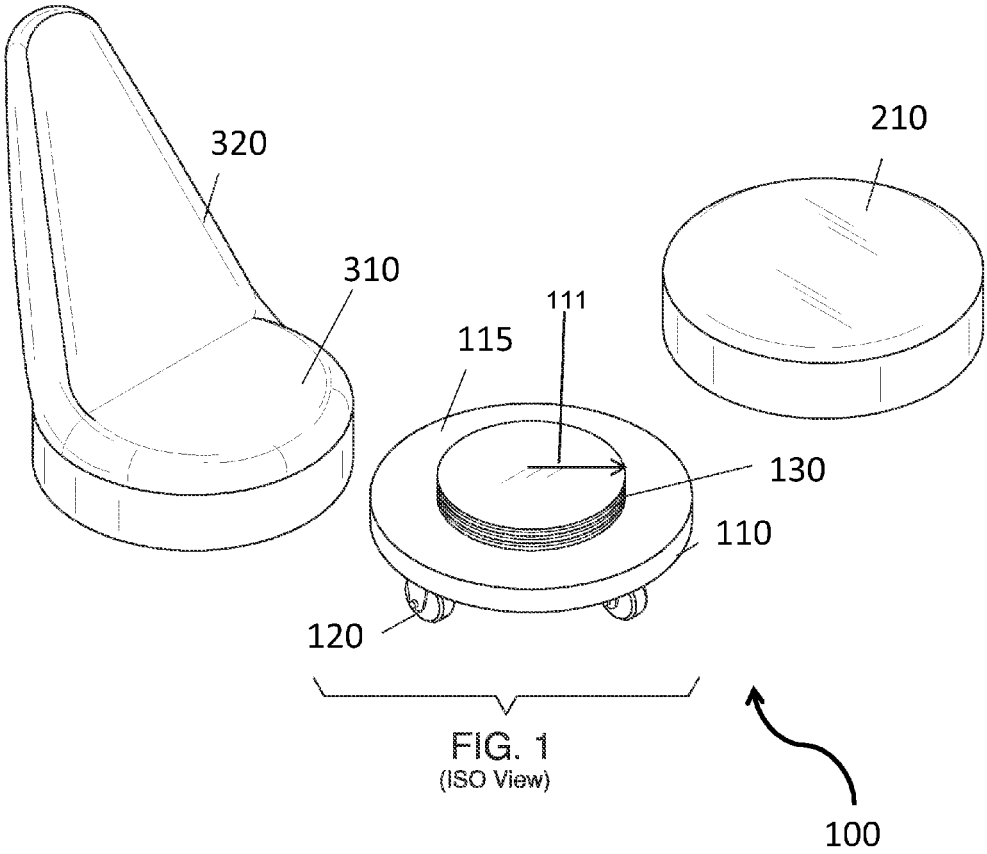
FIG. 1 shows a perspective view of the system of the present invention.
Figure 2:
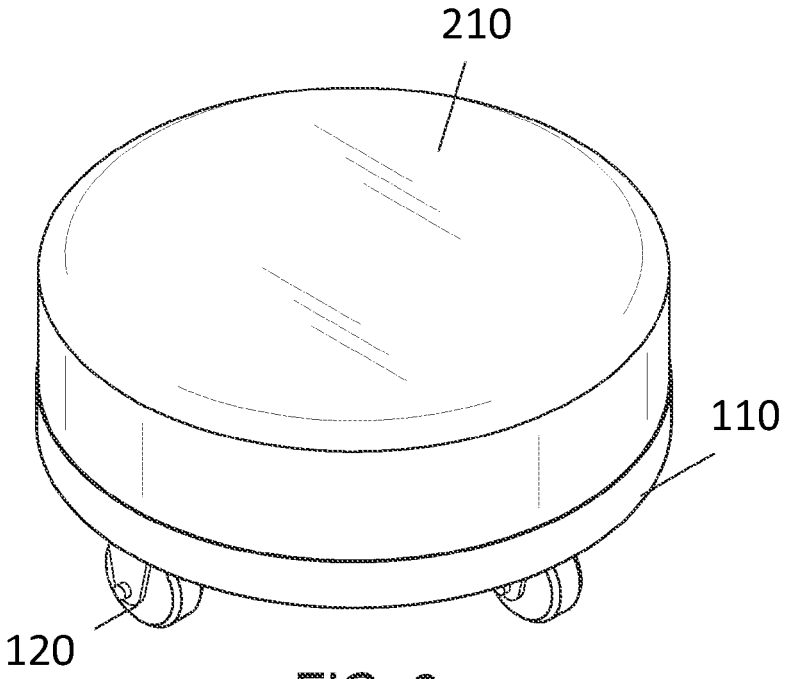
FIG. 2 shows a perspective view of the base and base cushion of the system of the present invention.
Figure 3:
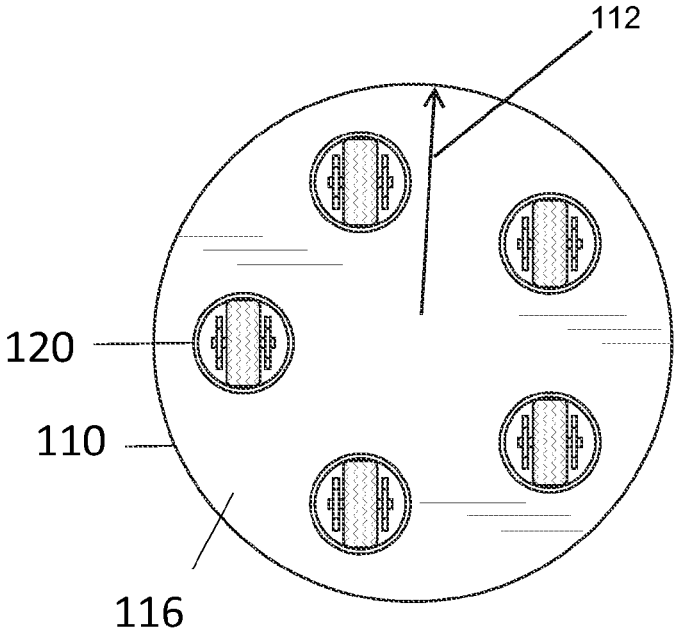
FIG. 3 shows a bottom view of the base of the system of the present invention.

Following is a list of elements corresponding to a particular element referred to herein:

100 mobile seat system
110 base
115 top surface
116 bottom surface of base
120 wheels
130 threaded protrusion
210 base cushion
216 bottom surface of base cushion
230 threaded indentation
310 support cushion
320 back support component
330 threaded indentation Referring now to FIG. 1-6, the present invention features a mobile seat system (100). The system (100) of the present invention helps position the user near the ground surface. As shown in FIG. 1, the system (100) comprises a base (110). Disposed on the bottom surface (116) of the base (110) is a plurality of wheels (120). The wheels (120) may be arranged in any particular fashion on the bottom surface (116). In some embodiments, the wheels (120) are arranged along the outer edge of the bottom surface (116) of the base (110). In some embodiments, the wheels (120) are caster wheels.

The system (100) comprises a base cushion (210). The base cushion (210) is removably attached to the top surface (115) of the base (110). The base cushion (210) covers the entire top surface (115) of the base (110).

Figure 4:
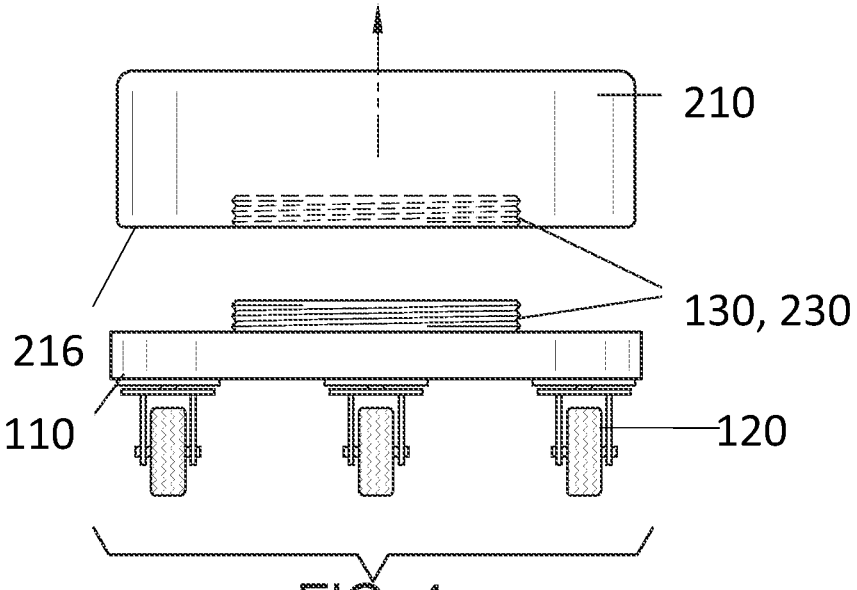
FIG. 4 shows a front view of the system of the present invention.
Figure 5:
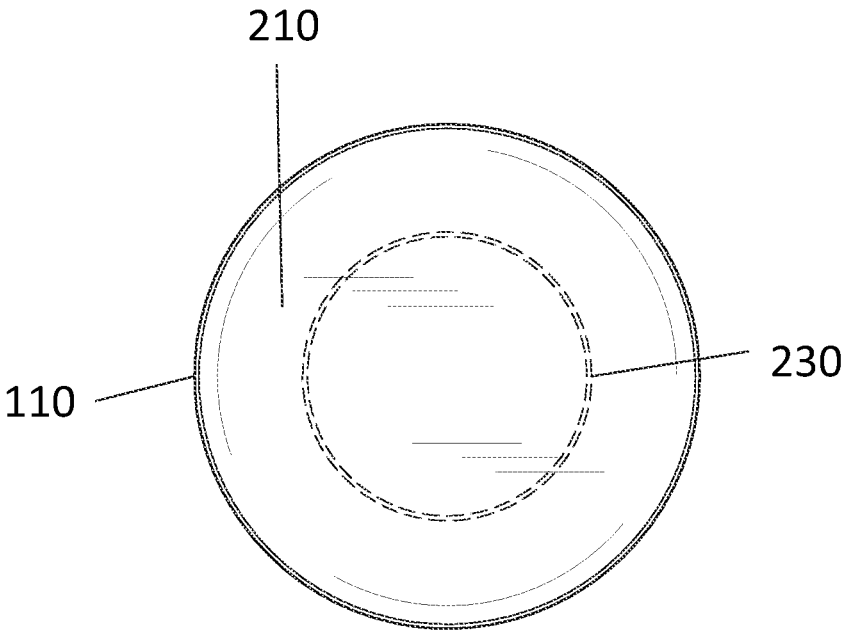
FIG. 5 shows a top view of the system of the present invention.

The base cushion (210) can be attached to and removed from the base (110) via a screw-like mechanism. As shown in FIG. 4, a threaded protrusion (130) is disposed on and extends upwardly from the top surface (115) of the base (110). A threaded indentation (230) is disposed in the bottom surface (216) of the base cushion (210). The threaded indentation (230) is adapted to accept the threaded protrusion (130) to attach the base cushion (210) to the base (110) (see FIG. 4).

Figure 6:
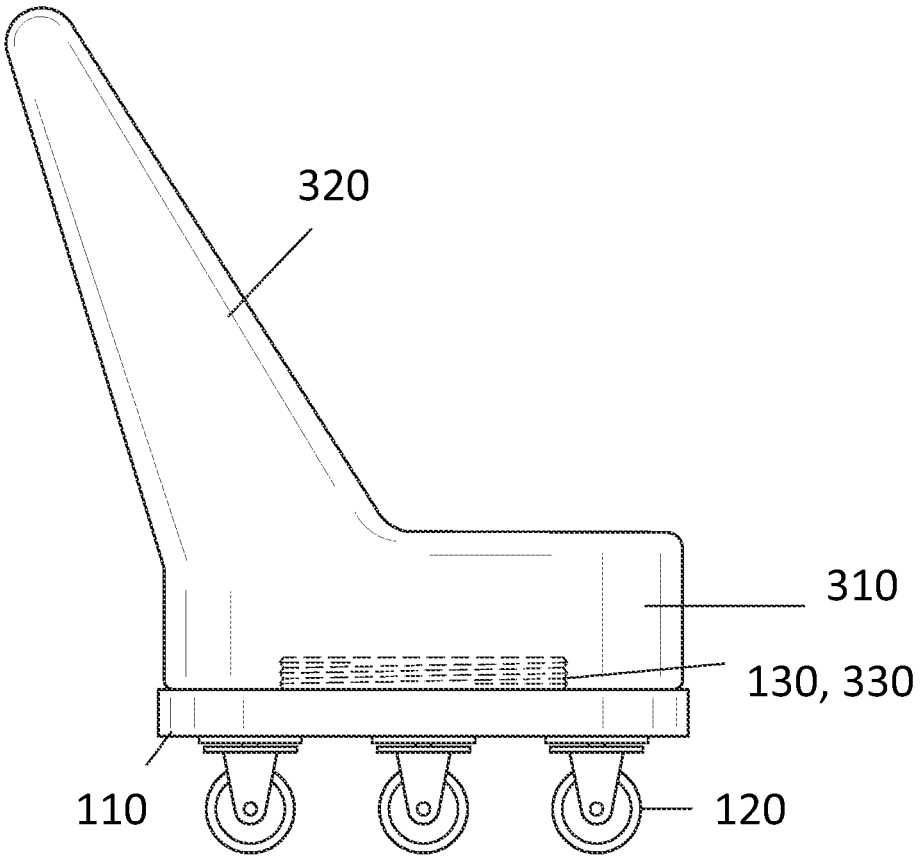
FIG. 6 shows a side view of an alternative embodiment of the system of the present invention.

The system (100) further comprises a support cushion (310) removably attached to the base (110) in the same manner as the base cushion (210). The support cushion (310), as shown in FIG. 6, comprises a back support component (320), which supports the users back when he/she is sitting atop the support cushion (310).

The support cushion (310) can be attached to and removed from the base (110) via a screw-like mechanism. As shown in FIG. 6, a threaded indentation (330) is disposed in the bottom surface of the support cushion (310). The threaded indentation (330) is adapted to accept the threaded protrusion (130) of the base (110) to attach the support cushion (310) to the base (110) (see FIG. 6).

The base cushion and support cushion position the user close to the ground surface. This allows the user to work at a low level without bending over or having to kneel.

Without wishing to limit the present invention to any theory or mechanism, the present invention is advantageous because the system features a separate base with two attachable cushions. The base is generally round. Wheels, e.g., caster wheels, are attached to the bottom surface in a manner that helps prevent the tipping of the base.

As used herein, the term "about" refers to plus or minus 10% of the referenced number.

The disclosures of the following U.S. patents are incorporated in their entirety by reference herein: U.S. Pat. No. 2,267,158; U.S. Pat. No. 3,976,155; U.S. Pat. No. 4,397,374; U.S. Pat. No. 5,611,551; U.S. Pat. No. 6,398,234; U.S. Pat. No.

6,733,073; U.S. Pat. No. 7,658,442; U.S. Pat. No. D266,292; U.S. Design Pat. No. D298,674; U.S. Design Pat. No. D579,679.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A mobile seat system (100) for positioning a user low to a ground surface, said system (100) consisting of:

(a) a circular base (110), a plurality of caster wheels (120) are disposed on a bottom surface (116) of the base (110), a centrally located, circular threaded protrusion (130) extends upwardly from a top surface (115) of the circular base (110); wherein a radius (111) of the centrally located circular threaded protrusion (130) is smaller than at least half of a radius (112) of the circular base (110);

(b) a base cushion (210), wherein a threaded indentation (230) is disposed in the bottom surface (216) of the base cushion (210), the threaded indentation (230) is adapted to accept the centrally located circular threaded protrusion (130) of the base (110) to temporarily attach the base cushion (210) to the base (110); and (c) a support cushion (310), a back support component (320) extends upwardly from the support cushion (310) to support a user's back, wherein a threaded indentation (330) is disposed in a bottom surface of the support cushion (310), the threaded indentation (330) is adapted to accept the centrally located circular threaded protrusion (130) of the base (110) to temporarily attach the support cushion (310) to the base (110);

wherein the base cushion (210) and support cushion (310) are interchangeable on the base (110), wherein the system (100) positions the user close to the ground surface.

* * * * *